US007828511B1

(12) United States Patent
Pinera et al.

(10) Patent No.: US 7,828,511 B1
(45) Date of Patent: Nov. 9, 2010

(54) AXIAL TIP TURBINE DRIVEN PUMP

(75) Inventors: Alex Pinera, Jupiter, FL (US); Frank W Huber, Palm Beach Gardens, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 492 days.

(21) Appl. No.: 12/050,760

(22) Filed: Mar. 18, 2008

(51) Int. Cl.
*F04D 29/18* (2006.01)

(52) U.S. Cl. ..... 415/72; 415/73; 415/77; 415/221; 416/171; 416/176; 416/189; 416/198 A; 416/203

(58) Field of Classification Search ..... 415/415, 415/72, 73, 77, 83, 84, 91, 221; 416/171, 416/176, 189, 198 A, 203; 417/351, 392, 417/406

See application file for complete search history.

(56) References Cited

U.S. PATENT DOCUMENTS

| | | | | | |
|---|---|---|---|---|---|
| 2,956,502 | A | * | 10/1960 | Glaser et al. | 184/6.11 |
| 2,962,206 | A | * | 11/1960 | Borden et al. | 415/147 |
| 3,004,494 | A | * | 10/1961 | Corbett | 417/245 |
| 3,103,176 | A | | 9/1963 | Lang et al. | |
| 3,200,753 | A | | 8/1965 | Di Stefano et al. | |
| 3,734,649 | A | * | 5/1973 | Sandy, Jr. | 417/370 |
| 4,155,684 | A | | 5/1979 | Curiel | |
| 4,589,253 | A | | 5/1986 | Wagner | |
| 4,642,023 | A | | 2/1987 | Dunn | |
| 4,708,584 | A | | 11/1987 | Meng | |
| 5,074,762 | A | | 12/1991 | Mechin | |
| 5,077,968 | A | | 1/1992 | Branstrom | |
| 5,156,534 | A | | 10/1992 | Burgy | |
| 5,197,851 | A | | 3/1993 | Girault | |
| 5,224,817 | A | | 7/1993 | Girault | |
| 5,551,230 | A | | 9/1996 | Meng | |
| 7,070,388 | B2 | | 7/2006 | Meng | |

FOREIGN PATENT DOCUMENTS

| | | |
|---|---|---|
| SU | 939827 | 6/1982 |

* cited by examiner

*Primary Examiner*—Ninh H Nguyen
(74) *Attorney, Agent, or Firm*—John Ryznic

(57) ABSTRACT

An axial tip turbine driven pump in which a first fluid pumped by an inducer is driven by a second fluid that reacts with a turbine blade extending from a shroud on the inducer. The inducer includes a set of screw thread blades and a second set of partial blades that are covered by a shroud in the aft section of the inducer. A row of turbine blades extends from the shroud and into a manifold that forms the outer casing for the pump. The fluid flow through the manifold reacts with the turbine blades and drives the inducer to pump the fluid from the inlet and through guide vanes downstream from the inducer. The fluid passing through the turbine blades is collected in an outlet collector manifold and discharged into the fluid flowing through the guide vanes. The inducer with the turbine blades is rotatably supported within the housing formed by the guide vane support member and the manifold casing. The swirl flow direction of the turbine blades is opposite to that of the swirl flow in the inducer. The structure that rejoins the two fluids redirects the turbine blade flow into the same swirl direction as the inducer flow.

19 Claims, 3 Drawing Sheets

AXIAL TIP TURBINE DRIVEN PUMP

FEDERAL RESEARCH STATEMENT

None.

CROSS-REFERENCE TO RELATED APPLICATIONS

None.

BACKGROUND OF THE INVENTION

1. Field of the Invention

The present invention relates generally to a liquid propellant rocket engine, and more specifically to a low pressure pump for a turbopump for the rocket engine.

2. Description of the Related Art Including Information Disclosed Under 37 CFR 1.97 and 1.98

Turbopump feed systems are used for high thrust and long duration liquid propellant rocket engines in order to lower the system weight and raise performance over the pressurized gas feed systems. The turbopump fed systems requires only relatively low pump inlet pressures, and thus low propellant tank pressures, while the major portion of the pressure required at the thrust chamber inlets is supplied by the pumps. This saves considerable tank weight, particularly for larger vehicles.

The overall trend is toward higher chamber pressure for liquid propellant rocket engines. The role of the turbopump in the entire system becomes of greater importance, particularly with the high-performance hydrogen-fueled engines. The advantage of the pump-fed over the pressure-fed engines increases as mission velocity requirements increase, and becomes very substantial as orbit-insertion velocities are approached.

The rocket engine designer must ensure that propellants go to the inlet of the pumps at required minimum pressures. The turbopump feed system raises the pressure of the propellants received from the vehicle tanks and delivers them to the main thrust chamber, through ducts and valves, at pressure and flow rates commensurate with rated engine operation. The principal requirements of the rocket engine propellant pump are high reliability, low cost, light weight, stable flow for the required operating range, and long life.

The principal requirements of a rocket engine propellant pump are high reliability, low cost, light weight, stable flow for the required operating range, high efficiency, adequate suction performance, and long life. The relative importance of these factors and their resulting influence on the design will vary depending on the application. The most common used pump types are centrifugal (or radial), axial, or mixed flow pumps. Centrifugal pumps are usually designed with a single stage while axial pumps have multiple stages. Centrifugal pumps can handle large flows at high pressures efficiently as well as economically in terms of weight and size. Thus, almost all of the operational rocket propellant pumps are centrifugal pumps.

A centrifugal pump will accelerate the fluid flow by imparting kinetic energy to the fluid in the rotor and then decelerating, or diffusing, the fluid in the stator. This results in increased fluid pressure head. The rotor assembly usually includes an inducer, an impeller, bearings, and a shaft. The stator assembly consists of a casing with stationary diffuser vanes, a volute with discharge outlets, and seals.

An inducer, an axial flow rotor, increases total pressure of the entering fluid sufficiently to permit non-cavitating operation of the main impeller. An inducer can reduce the pump inlet pressure net positive suction head (NPSH) requirements substantially. The impeller of the centrifugal (or radial) pump basically is a rotating wheel with blades that discharge the flow in a radial direction. The inducer can consist of either a single or a double blade row. The inducer pump is used as low speed boost pumps to raise the pressure sufficiently to permit the main pump to operate at much higher speeds to reduce its size and cost.

A turbine is used to provide shaft power to the propellant pumps and typically derived their energy from the expansion of a high-pressure, high-temperature gas to lower pressures and temperatures. Turbines can be impulse or reaction. Impulse turbines can be either single or multiple staged. Reaction turbines are usually multistage. Impulse turbines are most frequently used for high pressure ratio, low flow applications, Reaction bladed turbines are more frequently used for low pressure ratio, high flow designs.

Several different types of engine cycles are available and can be classified primarily based on where the turbine drive fluid originates and where it is discharged after leaving the turbine. The specific type of coupling between turbine and pumps depends not only upon the propellants being pumped but also on the design of the overall engine system. Various turbopump drive arrangements are known in the art. Where a single pump turbine directly drives both propellant pumps through a common shaft, it can be located either on the shaft end (with back-to-back pump arrangement) or between pumps. Then both pumps and turbine will operate at the same shaft speed. Gear driven turbopump arrangements include the pancake type which uses different reduction gears and is applied where there are speed differentials between pumps and turbine, the offset turbine, with both pumps on one shaft but driven through a gear train; and the single geared pump where one pump is mounted with the turbine on the same shaft, while the other is driven through a reduction gear. Dual-shaft turbopump arrangements with pump and turbine for each propellant on separate shafts include two gas turbines in series, with the discharge gas from the first turbine driving the second turbine, and two gas turbines in parallel, both receiving gas directly from the power source.

Turbopump performance affects the vehicle payload in three ways. 1) Turbopump component weight. Since the turbopump components form a part of stage burnout weight, they directly affect stage burnout. 2) Required pump inlet suction pressure. Required suction pressure directly translates into required main propellant tank pressure level. Suction pressure raised, tank and pressurization system weights increase and thus reduce the stage payload for a given burnout weight. 3) Turbine gas flow rate. For gas generator cycles, the turbine drive gases are usually ejected at a lower specific impulse than the thrust chamber gases. Their flow rate decreases the overall Is (specific impulse) of the engine system and thus for a given velocity increment it decreases the allowable stage burnout weight. For a fixed weight of engines, tanks, guidance, and other equipment, a decrease in allowable stage burnout weight decreases payload weight.

Available pump suction pressure together with the basic pump flow characteristics will determine the maximum shaft speed at which the unit can operate. The higher this shaft speed, the lower the turbopump weight will likely be.

BRIEF SUMMARY OF THE INVENTION

It is an object of the present invention to provide for a turbopump propellant feed system for a rocket engine that is lighter than the prior art systems through the use of a more compacted design, and that also uses less ducts and valves than the prior art systems.

It is another object of the present invention to provide for a turbopump propellant feed system for a rocket engine that will run a low pressure pump at a different speed than the high pressure pump.

It is another object of the present invention to provide for a turbopump propellant feed system for a rocket engine that will use only a single hot turbine to drive the propellant pumps for increased life of the system.

It is another object of the present invention to provide for a turbopump propellant feed system for a rocket engine that requires only relatively low pressure pump inlet pressures in order to save considerable tank weight.

The present invention is a turbopump feed system for a rocket engine that supplies the fuel and the oxidizer to the engine nozzle. The turbopump includes a single rotor shaft with a hydraulic turbine located between the two pumps. A high pressure pump for each of the fuel and the oxidizer is located on the ends of the shaft. At the inlets for each of the two propellant pumps is a low pressure inducer type pump uncoupled from the main pump shaft in order to eliminate the need for reduction gear boxes or other mechanical transmission drives. The low pressure inducer pumps are each driven by bleed off fluid from the adjacent fuel or oxidizer high pressure pumps. The low pressure inducer pump is a double blade row inducer pump with an integral row of turbine blades facing outwards. The bleed off from the high pressure pumps is used to drive the low pressure inducer pumps. The low pressure inducer pumps deliver the fuel and the oxidizer to the high pressure main pumps with enough flow and pressure to enable the main pumps to operate at much higher speeds in order to reduce the size and weight and cost of the turbopump systems.

DETAILED DESCRIPTION OF THE INVENTION

Figure 1:
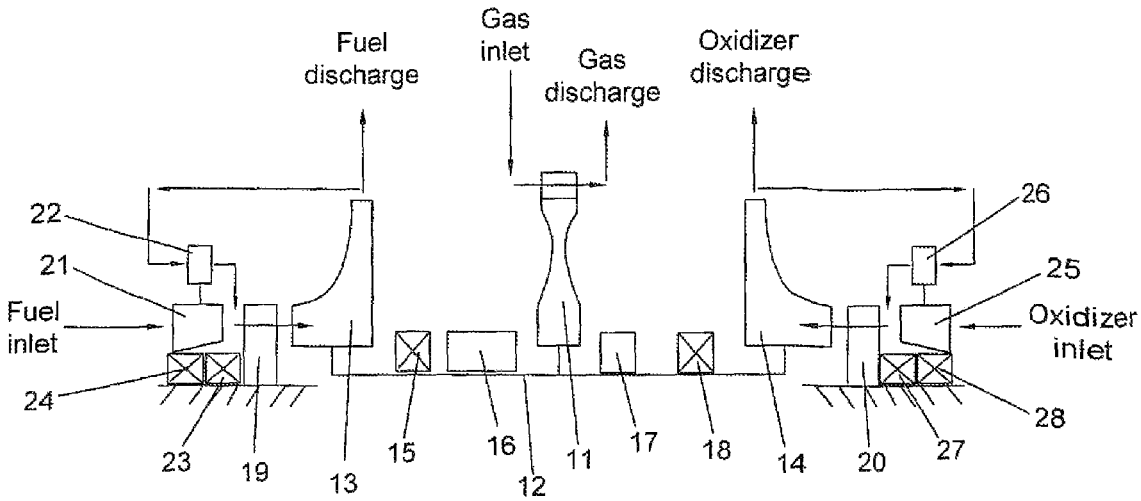
FIG. 1 shows a schematic view of the turbopump of the present invention.
Figure 2:
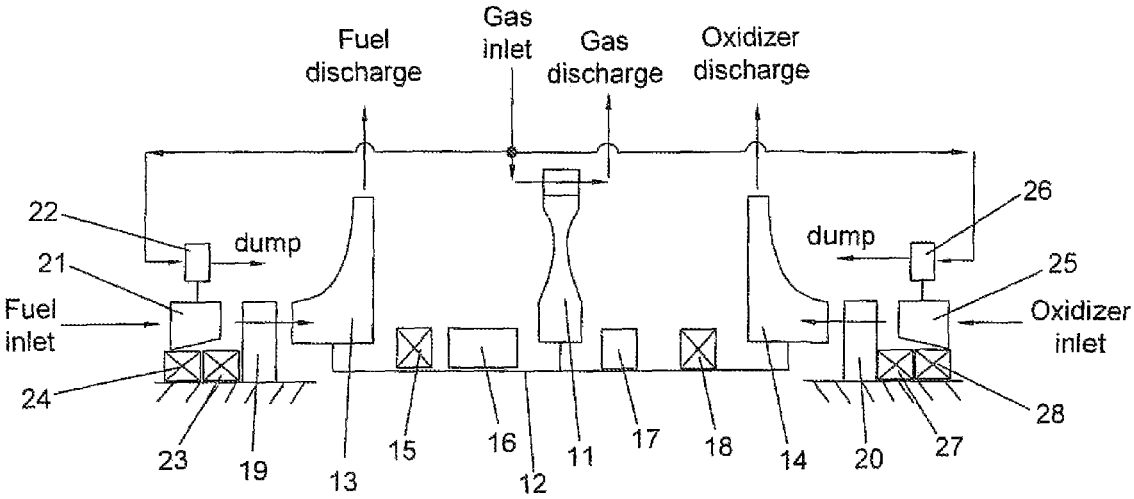
FIG. 2 shows a schematic view of a second embodiment of the turbopump of the present invention.

The present invention is turbopump feed system for a rocket engine and is shown in several embodiments in FIGS. 1 and 2. The turbopump of the present invention is used for high thrust and long duration liquid propellant rocket engines. The turbopump requires relatively low pressure pump inlet pressure and saves considerable tank weight by providing a more compact turbopump system with the use of less ducting and valving that the currently known prior art turbopumps. FIG. 1 shows a first embodiment of the turbopump of the present invention. A single turbine rotor disk 11 with a row of blades is rotatably secured to a rotor shaft 12 of the turbopump. The turbine rotor disk 11 is centrally located along the shaft 12 for compactness but could be slightly offset without departing from the spirit and scope of the present invention. On one end of the shaft 12 is a first high speed centrifugal pump 13 with a first bearing 15 to rotatably support the shaft 12 and an inter-propellant seal 16 to separate the two propellant liquids (such as liquid hydrogen and oxygen) from one another. On the other end of the shaft 12 is a second high speed centrifugal pump 14 with a second bearing 18 to rotatably support this end of the shaft 12 and a dynamic shaft seal 17. The turbine disk 11 is driven by a pre-burner or a gas generator by passing the liquid through the turbine blades to rotate the shaft and therefore drive the two centrifugal impeller 13 and 14.

Located upstream from the first centrifugal pump are a row of guide vanes 19 and a first low pressure pump 21 uncoupled (not mechanically connected) from the first high pressure pump 13 and the shaft 12. The first low pressure pump includes a two blade row inducer 21 to supply low pressure propellant fuel to the inlet of the first high pressure pump 13. The first low pressure pump also includes a row of turbine blades 22 extending outward from the blade shroud that forms a flow path for the liquid through the inducer 21. The first low pressure pump 21 is rotatably supported by an inner bearing 24 and an outer bearing 23.

A second low pressure pump is located on the upstream side of the second high pressure pump 14 and includes the same structure as the first low pressure pump 21. A row of guide vanes 20 guides the fluid from the low pressure pump 25 into the inlet of the second high pressure pump 14. The second low pressure pump includes a two blade row inducer 25 to supply low pressure propellant oxidizer to the inlet of the second high pressure pump 14. The second low pressure pump 25 also includes a row of turbine blades 26 extending outward from the blade shroud that forms a flow path for the liquid through the inducer 25. The second low pressure pump 25 is rotatably supported by bearings 27 and 28.

The turbopump of the FIG. 1 embodiment operates as follows. A gas from the pre-burner or a gas generator supplies high pressure liquid to the inlet side of the turbine blades to drive the rotor disk 11 and thus the turbopump shaft 12. Rotation of the turbopump shall 12 drives the first and second high pressure pumps 13 and 14 to supply high pressure rocket propellant fuel and high pressure propellant oxidizer to the combustion chamber of the nozzle. A portion of the high pressure fuel is bled off from the first high pressure pump 13 and passed through the turbine blades 22 integral with the first low pressure pump to drive the first inducer 21 which supplies low pressure fuel to the inlet of the first high pressure pump 13. A portion of the high pressure oxidizer is bled off from the second high pressure pump 14 and passed through the turbine blades 26 integral with the second low pressure pump to drive the second inducer 25 which then supplies low pressure oxidizer to the inlet of the second high pressure pump 14. Several bearings rotatably support the turbopump shaft 12 and the two low pressure pumps 21 and 25. The guide vanes 19 and 20 direct the low pressure fluids into the respective inlets of the high pressure pumps 13 and 14. IPS or inter-propellant seal 16 separates the fuel leakage from the oxidizer leakage in order to eliminate any mixing of these fluids within the turbopump.

A second embodiment of the turbopump of the present invention is shown in FIG. 2 and differs from the first embodiment of FIG. 1 in that the fluid that drives the inducer turbine blades is not bled off from the high pressure pumps and is not re-supplied to the inlet of the high pressure pump. Thus, the embodiment of FIG. 2 can use a separate high pressure fluid to drive the diffuser turbine blades. In FIG. 2, the high pressure gas that drives the main shaft turbine rotor disk 11 is bled off and passed through the manifold with the diffuser turbine blades 22 to drive the low pressure pump. The discharge from the diffuser turbine blades 22 is dumped to the outside and not used in the remainder of the turbopump. Both the low pressure pump for the fuel and the oxidizer is driven with high pressure gas bled off from the main rotor disk drive fluid, and both of the diffuser turbine blade exhaust gas is dumped outside of the turbopump.

Figure 3:
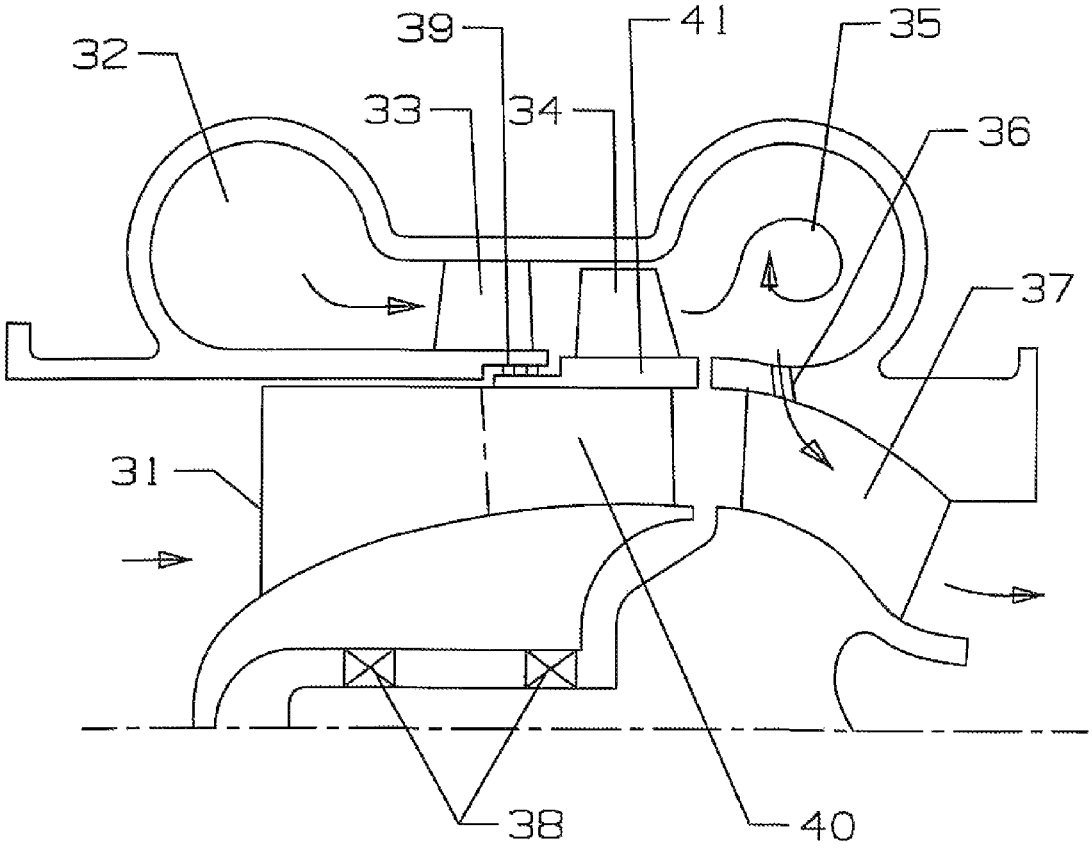
FIG. 3 shows a cross section view of the details of the low pressure pump used in the turbopump of the first embodiment of the present invention.
Figure 4:
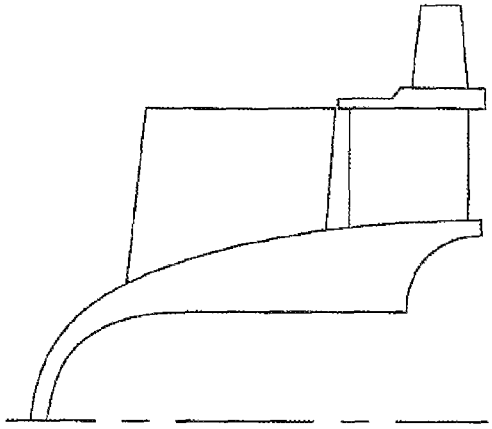
FIG. 4 shows a cross section view of the two blade row inducer with the integral turbine blades of the present invention.

FIG. 3 shows a detailed view of the low pressure pump assembly 21 in FIG. 1. The low pressure pump includes the two blade row inducer with a first row of blades 31 extending from the forward end to the aft end of the inducer and a second row of blades 40 that extend about midway in the inducer and end at the aft end like the first blades 31. The inducer includes screw thread blades with partial blades in-between the spiral blades on the aft end of the inducer. The inducer blades are supported by an inner shroud and an outer shroud 41. A row of turbine blades 34 extends outward from the outer shroud 41 and into a flow path between an inlet manifold 32 and a collector manifold 35. A row of guide vanes 37 extends in the flow path upstream from the turbine blades 34. A row of pump discharge guide vanes 37 is located downstream from the inducer outlet to guide the low pressure flow to the high pressure pump inlet. Two bearings 27 and 28 rotatably support the inducer on the pump discharge vane housing. A seal 39 is located between the stationary manifold housing and the rotating inducer assembly. A plurality of turbine discharge orifices 36 are formed in the manifold and pump discharge vane housing to pass the fluid from the collector manifold into the low pressure fluid passing through the guide vanes 37 to join the fluid being pumped by the inducer.

The low pressure pump of FIG. 3 operates as follows. The low pressure fluid from the tank is supplied to the inlet of the inducer where the rotation of the inducer raises the pressure by pumping the fluid through the screw thread blades 31 and partial blades 40 and into the guide vanes 37. Bleed off fluid from the high pressure pump of the turbopump is passed into the inlet manifold 32, through the turbine guide vanes 33 and the turbine blades 34, and then into the collector manifold 35. The high pressure bleed off fluid that flows through the turbine blades 34 causes the inducer to rotate and pressurize the fluid in the low pressure pump. The fluid flow into the collector manifold 35 is then directed through the turbine discharge orifices 36 and into the low pressure fluid in between the guide vanes 37. The fluid flow from the guide vanes 37 is then directed into the inlet of the high pressure pump of the turbopump.

The key features of the shrouded two blade inducer are as follows. The partial shroud 41 on the inducer makes manufacturing much easier and reduces the stress on the inducer swirl blades 31. The screw thread blades 31 in the inducer extend from the forward end and end just before the partial blades 40 that have the shroud 41 formed around the outer ends and on which the turbine blades 34 extend therefrom. Some inducers provide for the screw thread blades to extend all the way back and end at the location where the partial blades 40 end. Placing a shroud around the partial blades 40 on this design would allow for the stress to flow into the aft ends of the screw thread blades. By forming a gap or space between the ends of the screw thread blades 31 and the beginning or forward ends of the partial blades 40, the stress is limited to the partial blades only. The partial blades 40 on the back of the pump give more support to carry the torque of the turbine while improving the pump performance. The re-introduction of the turbine flow into the pump flow is important on hydraulic style turbines like the ones used on rocket engine turbopumps. The hard part here is that the turbine discharge flow usually has opposite swirl from the pump flow. Thus, the reason for the swirl redirecting orifices or vanes of the present invention.

One main feature of the collector manifold 35 and the discharge orifices 36 is the redirection of the manifold fluid into the inducer fluid. The manifold fluid flow and the inducer fluid flow both flow with opposite swirl flow directions. Thus, the direction of the discharge from the inducer might be clockwise swirl while the discharge from the turbine blades 34 might be counter-clockwise swirl direction. To mix these two discharges, the swirl directions must be in the same direction. Thus, the collector manifold 35 in the FIG. 3 embodiment with the discharge orifices 36 redirect the flow form the turbine blades 34 to have a similar swirl flow as the discharge from the low pressure pump 40 through the guide vanes 37.

Figure 5:
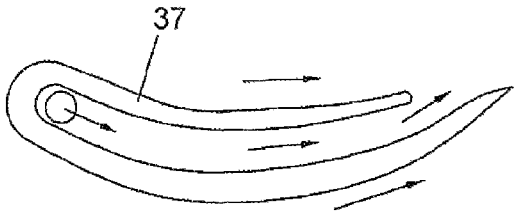
FIG. 5 shows a cross section top view of a second embodiment of the inducer mixing arrangement of the present invention.

FIG. 5 shows a second embodiment for redirecting the swirl discharge flow from the turbine blades 34. The discharge flow from the turbine blades 34 is collected in the manifold and then passed into passages formed within the guide vanes 37 and discharged out the pressure or concave sides through exit openings formed at the trailing edge region of the vanes as seen in FIG. 5.

Figure 6:
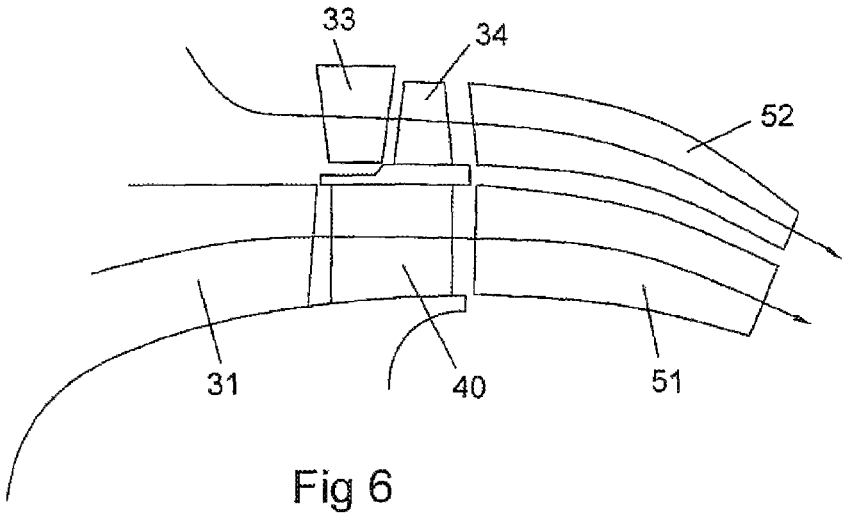
FIG. 6 shows a cross section top view of a third embodiment of the inducer mixing arrangement of the present invention.

FIG. 6 shows a third embodiment for redirecting the swirl discharge flow from the turbine blades 34. The discharge flow from the turbine blades 34 is passed through an exit guide vane 52 to turn the flow in the direction of the pump discharge flow that is passing through another set of guide vanes 51. The two guide vanes 51 and 52 then discharge the flow with the same swirl direction into the inlet of the high pressure pump.

We claim the following:

1. A turbine driven pump comprising:

An inducer with a first set of blades having a screw thread shaped blades on the inlet end of the inducer;

A row of guide vanes located downstream from the inducer;

A shroud covering the all end of the inducer;

A row of turbine blades extending outward from the shroud;

A manifold forming a fluid flow path through the turbine blades; and,

Means to combine the fluid flow from the turbine blades with the fluid flow from the inducer.

2. The turbine driven pump of claim 1, and further comprising:

The manifold forms an outer casing for the inducer.

3. The turbine driven pump of claim 1, and further comprising:

The manifold includes a row of guide vanes upstream from the turbine blades to guide the fluid into the turbine blades.

4. The turbine driven pump of claim 1, and further comprising:

The manifold includes a collector manifold downstream from the turbine blades.

5. The turbine driven pump of claim 4, and further comprising:

The means to combine the fluid flow from the turbine blades with the fluid flow from the inducer includes a plurality of discharge orifices connecting the collector manifold with the guide vanes.

6. The turbine driven pump of claim 4, and further comprising:

The means to combine the fluid flow from the turbine blades with the fluid flow from the inducer includes a passage through the guide vanes with an opening along the trailing edge to discharge the fluid from the collector manifold into the fluid flow passing through the guide vanes.

7. The turbine driven pump of claim 1, and further comprising:

The means to combine the fluid flow from the turbine blades with the fluid flow from the inducer includes a second set guide vanes to direct the turbine blade fluid into the fluid flowing through the first set guide vanes.

8. The turbine driven pump of claim 7, and further comprising:

The first and the second sets of guide vanes have opposite swirl flow directions.

9. The turbine driven pump of claim 1, and further comprising:

The inducer includes a second set of rotor blades in the aft end of the inducer; and, The shroud is formed around the second set of blades.

10. The turbine driven pump of claim 9, and further comprising:

The screw thread blades end at a location upstream from the leading edge of the second set of blades.

11. The turbine driven pump of claim 10, and further comprising;

The first set of blades is not covered by the shroud.

12. The turbine driven pump of claim 9, and further comprising:

The screw thread blades extend toward the aft end of the inducer with the trailing edge portions of the blades extending in-between the second set of blades.

13. The turbine driven pump of claim 1, and further comprising:

the guide vanes extend from an inner casing that forms a support surface for bearings that rotatably support the inducer; and, the guide vanes support the manifold casing.

14. The turbine driven pump of claim 13, and further comprising:

A rotary seal between the inducer shroud and the manifold to seal the flow path through the manifold with the flow path through the inducer.

15. The turbine driven pump of claim 1, and further comprising;

The inducer includes a conical shaped inner flow path forming casing.

16. The turbine driven pump of claim 1, and further comprising:

The flow path of the inducer and the flow path of the manifold are in the same general axial direction but with opposite swirl directions.

17. The turbine driven pump of claim 1, and further comprising:

The inducer is a low pressure pump for a high pressure turbopump of a rocket engine.

18. The turbine driven pump of claim 17, and further comprising:

The fluid that drives the turbine blades is the same fluid that the inducer pump supplies to the high pressure turbopump.

19. The turbine driven pump of claim 1, and further comprising:

The flow from the turbine blades and the flow from the guide vanes have an opposite swirl direction; and, The means to combine the fluid flow from the turbine blades with the fluid flow from the inducer includes means to combine the two swirl flows into similar swirl flows.

* * * * *

UNITED STATES PATENT AND TRADEMARK OFFICE

CERTIFICATE OF CORRECTION

PATENT NO. : 7,828,511 B1
APPLICATION NO. : 12/050760
DATED : November 9, 2010
INVENTOR(S) : Alex Pinera and Frank W. Huber It is certified that error appears in the above-identified patent and that said Letters Patent is hereby corrected as shown below:

Col. 1, line 7, insert the following:

--[0002] This invention was made with Government support under contract number FA9300-07-C-0001 awarded by the US Air Force. The Government has certain rights in the invention.--

Signed and Sealed this
Fourteenth Day of August, 2012

David J. Kappos

David J. Kappos
*Director of the United States Patent and Trademark Office*